United States Patent [19]

Straitz, III et al.

[11] 4,140,471

[45] Feb. 20, 1979

[54] GROUND FLARE STACK

[75] Inventors: John F. Straitz, III, Meadowbrook, Pa.; Takeru Hamazaki, Yokohama, Japan

[73] Assignee: National Airoil Burner Company, Inc., Philadelphia, Pa.

[21] Appl. No.: 795,401

[22] Filed: May 9, 1977

[51] Int. Cl.[2] ..... F23C 1/08; F23C 9/04

[52] U.S. Cl. ..... 431/5; 431/202; 431/61

[58] Field of Search ..... 431/202, 285, 5, 60, 431/61

[56] References Cited

U.S. PATENT DOCUMENTS

| | | | |
|---|---|---|---|
| 3,033,273 | 5/1962 | Zink | 431/285 X |
| 3,730,673 | 5/1973 | Straitz | 431/202 X |
| 3,754,869 | 8/1973 | Van Raden | 431/5 X |
| 3,779,689 | 12/1973 | Reed | 431/202 X |
| 3,852,023 | 12/1974 | Itoh | 431/202 |
| 3,885,919 | 5/1975 | Pillard | 431/202 X |
| 3,954,386 | 5/1976 | Harpenslager | 431/285 X |
| 3,994,671 | 11/1976 | Straitz | 431/5 X |

FOREIGN PATENT DOCUMENTS

| | | | |
|---|---|---|---|
| 2339521 | 2/1974 | Fed. Rep. of Germany | 431/202 |

*Primary Examiner*—Alan Cohan

*Attorney, Agent, or Firm*—Zachary T. Wobensmith, II; Zachary T. Wobensmith, III

[57] ABSTRACT

A ground flare stack is described having a plurality of stages for combustion to accommodate various quantities of combustible waste gas, the stack having a dished base of gravel with a central combustion chamber with an enlarged opening at the bottom for entrance of air to support combustion, the central combustion chamber having an enlargement at its upper end with a converging discharge, a plurality of stages of combustion being provided within the chamber, the central combustion chamber being surrounded by a stack in spaced relation with a converging portion disposed around the combustion chamber enlargement and a cylindrical stack thereabove, with a diode to prevent downflow through the cylindrical stack, an acoustical and wind shielding fence being around the bottom of the stack permitting air to be supplied to the bottom of the stack and of the combustion chamber, additional stages of combustion being provided outwardly of the upper end of the central combustion chamber.

19 Claims, 6 Drawing Figures

GROUND FLARE STACK

CROSS REFERENCE TO RELATED APPLICATION

This application involves additions and improvements to the invention described in an application of John F. Straitz, III for Flare Burner, filed Mar. 28, 1977, Ser. No. 781,849.

BACKGROUND OF THE INVENTION

1. Field of the Invention

This invention relates to ground flare stacks and more particularly to such stacks for the burning of waste combustible gases containing various hydrocarbons.

2. Description of the Prior Art

It has heretofore been proposed to burn waste combustible gases employing successive stages to accommodate varied quantities of gas to be burned.

Nahas, in U.S. Pat. No. 3,322,178, shows a flare apparatus for staged combustion in a pit below ground level, Venturi burners being disposed along the sides of the pit.

Hoy, et al., in U.S. Pat. No. 3,881,857 show a combustor with a chamber divided into a plurality of zones having increasing numbers of air tubes so that progressively increasing areas may be ignited.

Beck, in U.S. Pat. No. 2,625,992 shows in a flat burner arrangement multiple gas burners in groups with provisions for utilizing a plurality of groups sequentially as required.

Reed et al., in U.S. Pat. No. 3,749,546, show in a flat pit burner a plurality of flow lines connected to a plurality of burners for utilization in stages, determined by the pressure of the gas.

The foregoing all require a relatively large flat surface area with the combustion exposed to view from the surrounding land area.

Pillard et al., in U.S. Pat. No. 3,885,919, show a residual gas burner with a smoke evacuating conduit at the base and a plurality of superposed coaxial combustion chambers of increasing volume with gas supplied to a number of burners varying in the same manner as the outflow of gases.

The waste gas burners of the staged type heretofore available require excessive area, do not adequately conceal the combustion glare and noise and have other shortcomings.

SUMMARY OF THE INVENTION

In accordance with the invention a ground flare stack is provided having an interior combustion chamber with a plurality of lower quantity level of combustion stages, the interior chamber being surrounded by the lower part of the stack which converges upwardly to a location above the top of the chamber, with other combustion stages at the top of the chamber, the stack extending upwardly and a fluidic diode being provided in the upper part of the stack to prevent downflow in the stack and to minimize possible combustion pulsations. Air induced at the various combustion stages enters at the bottom of the stack which is shielded by an acoustical, glare and wind shielding fence. Provisions are made for introduction of water containing oil and other combustibles and for the introduction of snuffing steam.

It is the principal object of the invention to provide a ground flare stack which is effective in the disposal of waste combustible gases and waste liquids, which does not require excessive area for installation and which does not adversely effect the nearby area by transmission of odors, noise or glare.

It is a further object of the invention to provide a ground flare stack which can accommodate a wide range of flow rates with stages of increasing capacity for this purpose.

It is a further object of the invention to provide a ground flare stack which can be utilized for the burning of a large variety of hydrocarbon waste streams.

It is a further object of the invention to provide a ground flare stack for proper disposal of waste water through the use of the energy available in the waste gas and without any supplementary fuel and without adversely affecting the gaseous combustion process.

It is a further object of the invention to provide additional safety features including a snuffing and purging action.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which.

Figure 1:
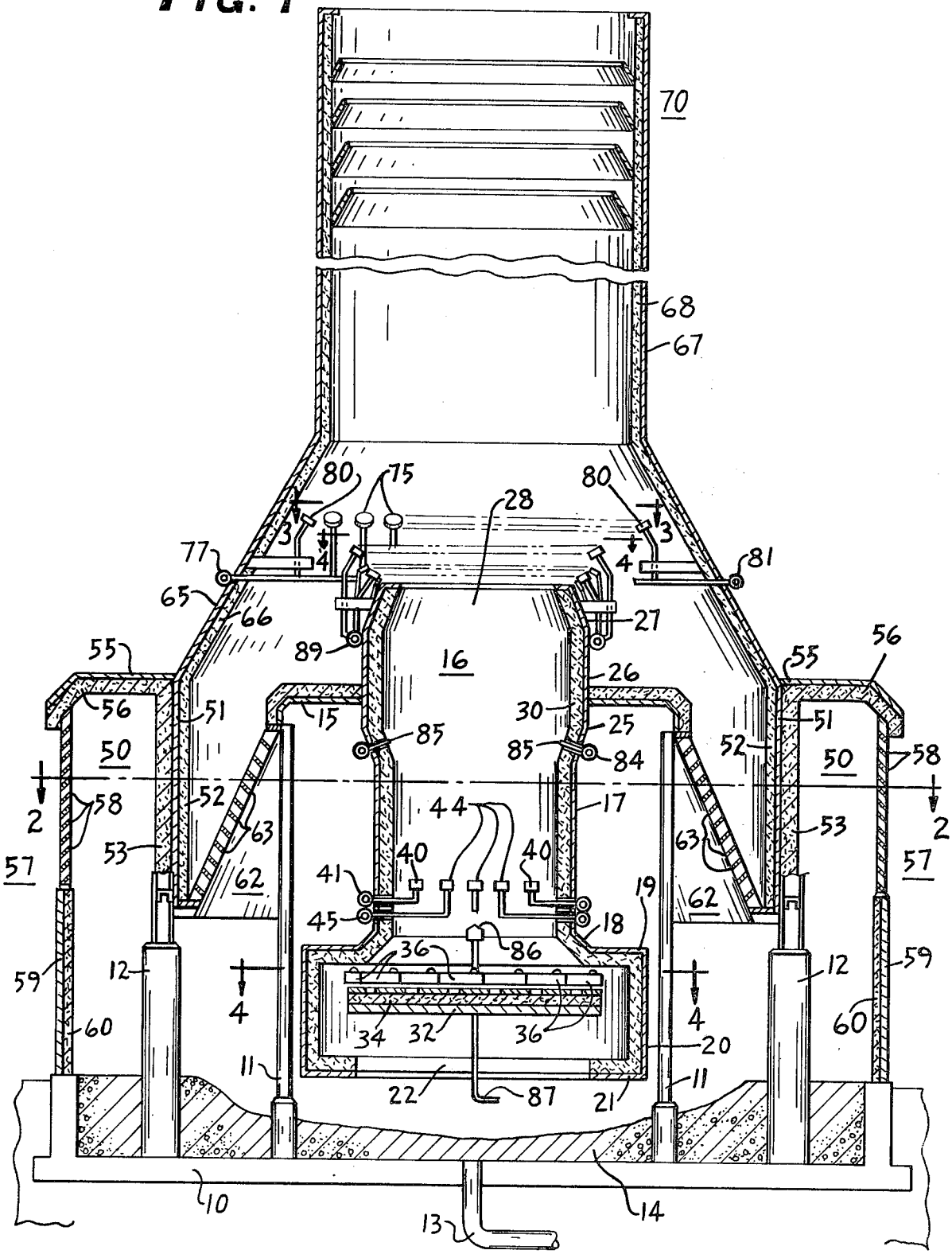
FIG. 1 is a vertical central sectional view of a ground flare stack in accordance with the invention.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings in which a preferred embodiment is shown a foundation 10 is provided from which circumferentially spaced inner posts 11 and circumferentially spaced outer posts 12 extend upwardly.

The foundation 10 is provided with a drain pipe 13 for discharge of rain water tending to collect above the foundation 10. The central portion of the foundation 10 and inwardly of the posts 12 is preferably covered with a layer of coarse gravel 14, preferably in concaved or dished form. The gravel is approximately 20 to 50 mm. in size and the minimum depth is preferably of the order of 150 mm. for noise absorption and reflection.

The posts 11 support, through a horizontal plate 15, an interior combustion chamber 16.

The combustion chamber 16 has a central circular cylindrical wall 17, a lower inclined outwardly extending wall 18 from which a horizontal wall 19 extends with a downwardly extending cylindrical wall 20 and an inwardly horizontally extending rim 21 with a central opening 22.

The central cylindrical wall 17 has an outwardly inclined wall 25 from which a circular cylindrical wall 26 extends upwardly with an upper converging wall 27 thereabove with a central opening 28.

The walls 17, 18, 19, 20, 21, 25, 26 and 27 are preferably of sheet metal and lined with a heat and sound insulating layer 30, preferably of a stable high temperature alumina silica ceramic fibrous material.

Within the space bounded by the walls 18, 19, 20 and the rim 21 a horizontal sound and heat baffle plate 32 is provided with its circumference inset from the wall 20 and its lining 30.

Figure 5:
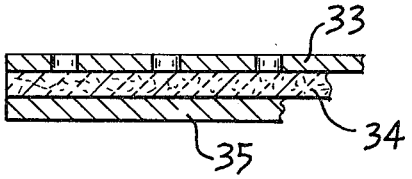
FIG. 5 is a vertical sectional view taken approximately on the line 5—5 of FIG. 4.

The baffle plate 32, as shown in detail in FIG. 5, has an inner perforated sheet 33 to permit the passage of sound, a central core 34 of ceramic fibrous material like the lining 30, and an outer metal plate 35.

The baffle plate 32, on the upper face thereof, has a plurality of pivoted streamlined vanes 36, carried on pivot pins 37 and adjusted in any desired manner to control the flow of air entering at the opening 22 and passing around the baffle plate 30 for delivery to the interior of the combustion chamber 16.

Figure 2:
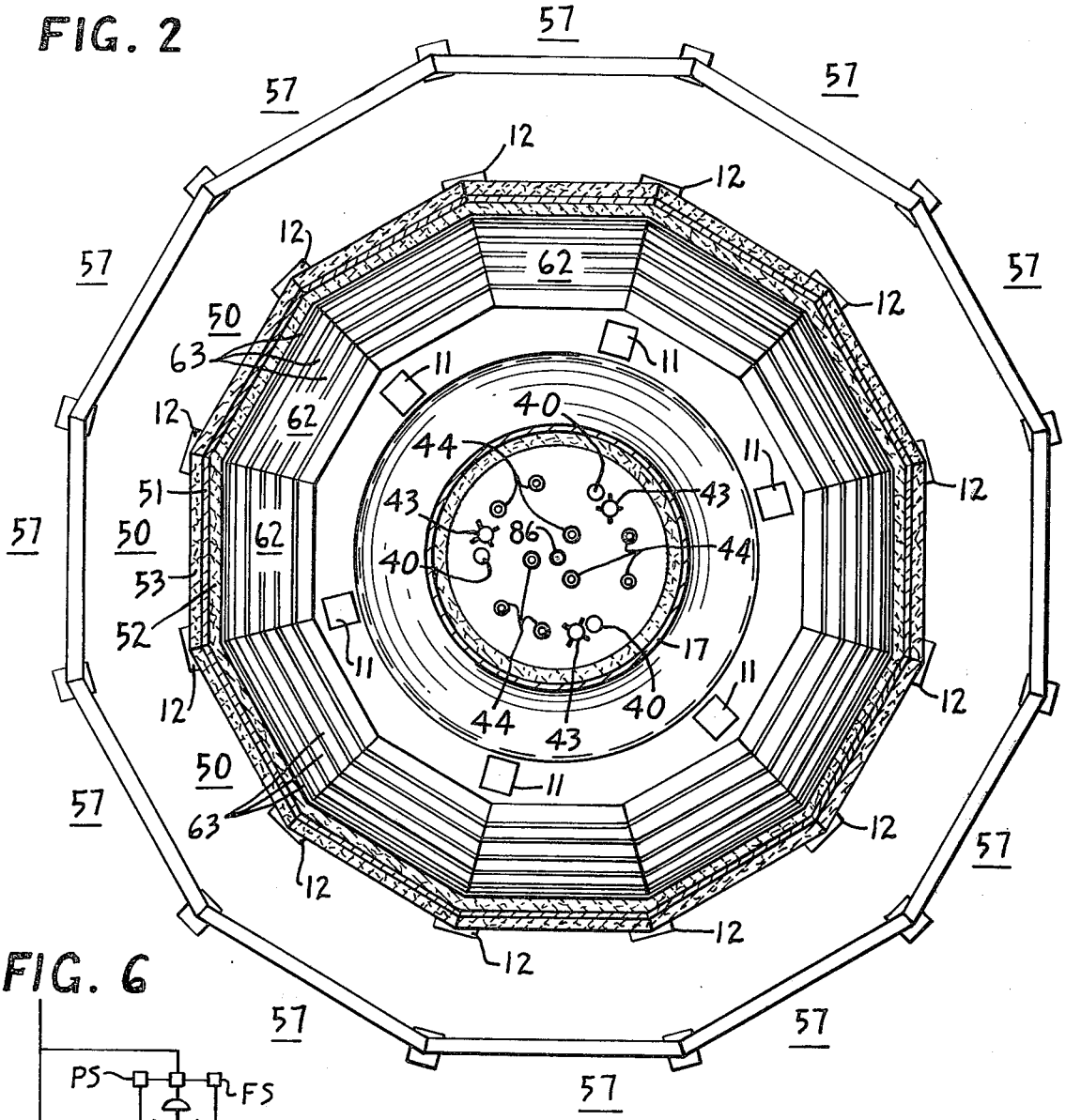
FIG. 2 is a horizontal sectional view taken approximately on the line 2—2 of FIG. 1.
Figure 3:
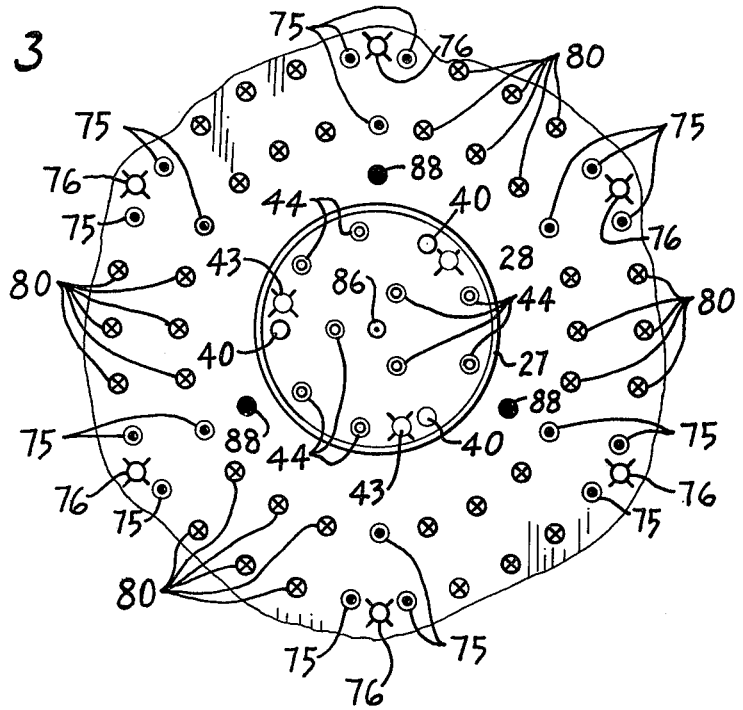
FIG. 3 is a horizontal sectional view, enlarged, taken approximately on the line 3—3 of FIG. 1 and showing multiple stages of burners.
Figure 4:
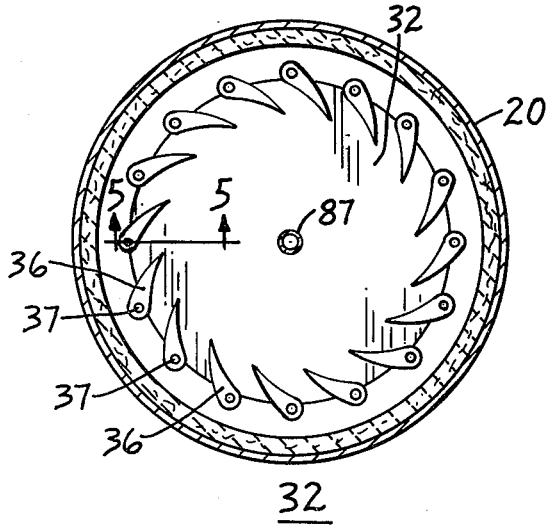
FIG. 4 is a horizontal sectional view taken approximately on the line 4—4 of FIG. 1.

Within the combustion chamber 16 at the lower part of the wall 17 and its lining 30 first stage waste gas burners 40 are provided three being shown in FIGS. 2 and 3, with combustible waste gas supplied thereto by header 41. The burners 40 can be of any desired type but those shown in the U.S. Pat. No. 3,463,602 to Gordon M. Bitterlich are suitable. Pilots 43 are provided for igniting the combustible gas from the burners 40.

Preferably at the same level in the combustion chamber 16 as the first stage burners 40, a plurality of second stage waste gas burners 44 are provided, nine being shown in FIGS. 2 and 3 with combustible waste gas supplied thereto by headers 45.

The posts 12 support a plurality of vertical acoustical and wind shield baffle wall panels 50 of metal plates 51 with interior linings 52 of high temperature alumina silica ceramic fibrous material and exterior linings 53 of sound absorbent glass fibrous material.

Extending outwardly from the tops of the panels 50 a hood 55 is provided with a lining 56 of sound absorbent glass fibrous material.

Louvres 57 having spaced inclined slats 58 for entrance of air extend downwardly from the hood 55 to base panels 59 carried on the foundation 10 and which preferably have linings 60 of sound absorbent glass fibrous material. Inclined louvres 62, having spaced inclined slats 63, for entrance of air, connect the lower margins of the panels 50 with the horizontal plate 15.

The wall panels 50 have extending upwardly therefrom a frustoconical wall 65 with a lining 66 of ceramic fibrous material from which a cylindrical stack 67 extends upwardly. The stack 67, has a ceramic fibrous lining 68 and at the upper part thereof has a fluidic diode 70 as shown in U.S. Pat. No. 3,730,673 for preventing down flow in the stack 67.

Within the wall 65 and its lining 66 (see FIGS. 1 and 3) and at a frusto-conical location perpendicular to the wall 65 and extending to the upper end of the wall 27 of the inner combustion chamber 16, a plurality of third stage burners 75 are mounted in two concentric circles, eighteen burners 75 being shown. Pilots 76 are provided with each group of three burners 75 for ignition. The burners 75 are connected to a manifold 77 for supplying waste gas thereto.

A plurality of fourth stage burners 80, are provided, preferably in the same concentric circles as the burners 75, thirty six burners 80 being shown. The burners 80 are connected to a manifold 81 for the supply of waste gas thereto.

A waste water supply manifold 84 is provided, preferably through the wall 25 and its covering 30, for introduction of waste water into the interior combustion chamber 16 through atomizing nozzles 85 for vaporization and incineration, the waste water being accompanied by oil and solid combustibles for disposal.

A lower steam snuffing nozzle 86 with a steam supply pipe 87 connected thereto and a plurality of upper steam snuffing nozzles 88, three being shown with a steam supply pipe 89 connected thereto may also be employed. The snuffing is employed in the event of failures or emergency conditions occurring as herein pointed out.

Figure 6:
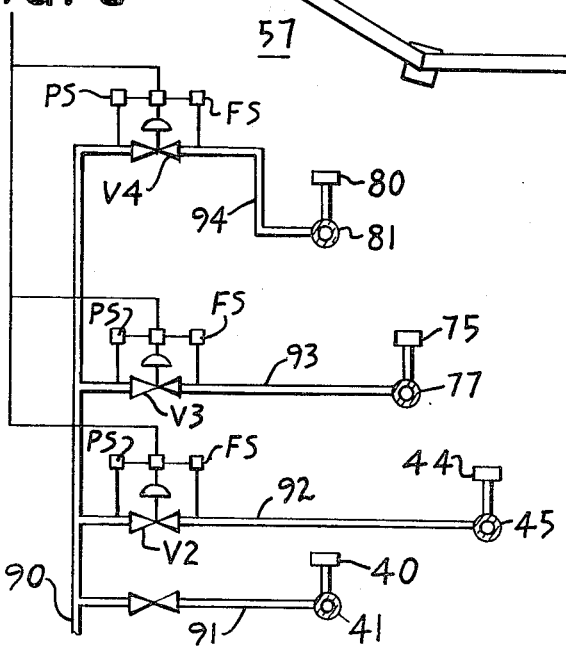
FIG. 6 is a diagrammatic view of a control system for the burners of the successive stages.

Any desired system may be utilized to control the delivery of the waste gas to the respective stages of burners. As shown in FIG. 6, the main waste gas supply pipe 90 has a plurality of branch lines 91, 92, 93 and 94 respectively connected thereto. The branch line 91 is connected to the manifold 41 for the first stage burner nozzles 40, the branch line 92 is connected to the manifold 45 for the second stage burner nozzles 44, the branch line 93 is connected to the manifold 77 for the third stage burner nozzles 75 and the branch line 94 is connected to the manifold 81 for the fourth stage burner nozzles 80.

Each of the branch pipes 92, 93 and 94 is provided respectively with an air or solenoid operated valve V2, V3 and V4 normally held closed by an air or electric signal, the valves being respectively moved to open position at predetermined gas pressure levels, sensed by a pressure sensor PS in each branch pipe and as determined by the quantity of waste gas delivered for combustion. The valves V2, V3 and V4 are held in open positions for a predetermined time interval after a closing signal determined by decreasing flow at a flow sensor FS in each branch line. These valves are intended to fail safe, i.e. open in the event of failure of electric power of air failure.

The mode of operation will now be pointed out.

Assuming that there is waste gas in the supply pipe 90 and in the branch pipe 91, waste gas will be delivered from the supply pipe 90 through the branch pipe 91 to the manifold 41 and thence to burner nozzles 40 for ignition by the pilots 43.

Air for combustion will be induced by the inner combustion chamber 16 and by the stack 67. Air for combustion of waste gas from burner nozzles 40 enters through louvres 57, between the posts 12, between the supports 11 and through the opening 22 in the rim 21 and then moves upwardly around the baffle plate 32 with a flow as determined by the setting of the vanes 36. The combustion of the gas from the burner nozzles 40 will occur preferably with a short flame in the lower part of the combustion chamber 16 and preferably below the levels of the waste water nozzles 85. Air induced by the stack 67 passes through louvres 62 and upwardly outside the rim 15 and the walls 26 and 27 for contact with the gases rising from the combustion chamber 16.

If there is an increase in the available waste gas sufficient to require the utilization of the second stage burner nozzles 44 this will be effected by reason of the pressure switch PS in the branch line 92 and the gases from the burner nozzles 44 will be ignited by the burning gases from the burner nozzles 40.

If a further increase in available combustible waste gas occurs this will be effective through the pressure switch PS in the branch pipe 93 for delivery of gas through the manifold 77 and the burner nozzles 75 outside the combustion chamber 16. The pilots 76 are effective for igniting the combustible waste gases from the burner nozzles 75.

Similarly, if further increase in availability of the waste gas occurs, delivery will be effected in the manner previously indicated through branch pipe 94 to the manifold 81 and burner nozzles 80. Ignition will be effected from the flames of the adjoining burner nozzles 75 of the third stage. The air for the combustion of the gas discharged from the burner nozzles 75 and 80, induced by the discharge and by the stack 67, passes upwardly outside the combustion chamber 16 being drawn through louvres 63 and into contact with the burning gases for aiding in their combustion.

The gases from one or more stages pass upwardly through the stack 68 and past the fluidic diode 70 for discharge from the stack 67. The fluidic diode 70 reduces downflow in the stack.

It will be noted that the panels 57 and 59 provide a wind shield reducing the effect of external wind. The panels 59 reduce light transmission and by reason of their interior linings 60 will reduce the transmission of low frequency vibrations of combustion and higher frequency vibrations of air entrance to the exterior.

The acoustical linings 53 of the wall panels 50 and the acoustical lining 56 of the hood 55 further aid in reducing sound transmission to the exterior.

The location of the water injector nozzles 55 at the locations shown in the combustion chamber 16 permit introducing waste water and vaporizing the same by the ascending hot gases without interfering with combustion and without smoke formation.

In the event of an unexpected emergency in the ground flare such as flame failure of all the pilot burners due to liquid carry-over, blocking by foreign matter, reduced pilot pressure or other abnormal occurrences, it will be desired to shut off the supply of waste gas delivered through the pipe 90 and otherwise dispose of it such as by discharge through an elevated flare or vent stack (not shown).

At the same time it is desirable that the ground flare be purged with steam supplied through the central nozzle 86 into and through the combustion chamber 16 and also through the nozzles 88 to further purge the flare. The nozzles 86 and 88 inspirate air which aids in the purging. These nozzles are preferably of the same type as those of the burner heads 40, 44, 75 and 80. The discharge of steam will quench any flames which might have continued.

We claim:

1. A ground flare stack comprising a combustion chamber open at the top and having its lower margin elevated for entry of air for supporting combustion in a first combustion zone in said combustion chamber, a wall surrounding said combustion chamber in spaced relation thereto and having its lower margin elevated for entry of air for distribution to said combustion chamber and to the interior of said wall and providing a second combustion zone above said combustion chamber, a stack extending upwardly from said wall for the discharge of products of combustion, a connection to a supply of waste combustible gas, members including first burner nozzles at the same level in the lower part of said combustion chamber in a plurality of groups connected to said supply connection of waste combustible gas for combustion in said first zone, each group of first burner nozzles including means responsive to increasing supply of waste gas to sequentially supply each group of first burner nozzles with waste gas so as to operate in a first plurality of stages, and members including second burner nozzles at the same level interiorly of said wall and exteriorly of said combustion chamber in a plurality of groups connected to said supply connection of waste combustible gas for combustion in said second zone each group of second burner nozzles including means responsive to an increasing supply of waste gas to sequentially supply each group of second nozzles with waste gas so as to operate in a second plurality of stages after the operation of the first burner nozzles.

2. A ground flare stack as defined in claim 1 in which at least one of the burner nozzles for at least one of said stages in said combustion chamber has an igniting pilot associated therewith.

3. A ground flare stack as defined in claim 1 in which at least one of the burner nozzles for at least one of said stages outside said combustion chamber has an igniting pilot associated therewith.

4. A ground flare stack as defined in claim 1 in which said stack at the upper part thereof has a fluidic diode therein for limiting downflow in said stack.

5. A ground flare stack as defined in claim 1 in which said combustion chamber has a plurality of movable members for controlling the flow of air thereinto.

6. A ground flare stack as defined in claim 1 in which a dished layer of gravel is provided below and facing the entrance to said combustion chamber.

7. A ground flare stack as defined in claim 1 in which noise shielding members are provided in surrounding relation to said combustion chamber and in sound absorbing relation to air delivered to said combustion chamber.

8. A ground flare stack as defined in claim 7 in which said noise shielding members are also associated with a portion of said wall.

9. A ground flare stack as defined in claim 1 in which control means responsive to the pressure of the waste combustible gas is provided for said members for supplying waste combustible gas to the interior of said wall, and for said members for supplying waste combustible gas to said combustion chamber, and said control means selectively activates burner nozzles in said respective stages in response to available waste combustible gas.

10. A ground flare stack as defined in claim 1 in which said members in each zone are respectively disposed in a concentric arrangement.

11. A ground flare stack as defined in claim 7 in which air directing louvre members spaced from said noise shield members are provided in the path of air for said combustion chamber.

12. A ground flare stack as defined in claim 7 in which air directing louvre members interiorly spaced with respect to said noise shielding members are provided in the path of the air to the interior of said wall.

13. A ground flare stack as defined in claim 1 in which said wall converges to said stack above the upper extremity of said combustion chamber.

14. The method of disposing waste water accompanied by combustible materials in a flare stack having a combustion chamber with waste combustible gas supplied thereto for combustion therein which comprises spraying the waste water into burning gases of combustion for vaporization and incineration of the waste water and accompanying materials.

15. A ground flare stack as defined in claim 1 in which means for supplying waste water accompanied by combustible materials is provided, and spray members are provided for introducing said waste water into said combustion chamber at the upper part thereof.

16. A ground flare stack as defined in claim 15 in which said spray members are directed inwardly and upwardly and above the burning gases from the burner nozzles in the lower part of the combustion chamber.

17. A ground flare stack as defined in claim 1 in which snuffing nozzle means is provided below the burner nozzles in the lower part of said combustion chamber supplying steam for extinguishing combustion at said burner nozzles and at said first zone, and a fluid connection is provided for supplying steam to said snuffing nozzle means.

18. A ground flare stack as defined in claim 1 in which spaced snuffing nozzle members are provided at the upper part of said combustion chamber supplying steam for extinguishing combustion at said second zone, and a fluid connection is provided associated with the burner nozzles interiorly of said wall for supplying steam to said snuffing nozzles.

19. A ground flare stack comprising a combustion chamber open at the top for discharge of gases of combustion and at the bottom for entrance of air for combustion, members at the bottom of said combustion chamber for supplying waste combustible gas to the lower part of said combustion chamber for combustion in said chamber, a source of waste water and liquid combustible materials, and spray members intermediate the top and bottom of said combustion chamber and connected to said source for introducing the liquid materials from said source into contact with the burning gases in said combustion chamber for vaporization and incineration by the combustion in said combustion chamber.

* * * * *